US005662505A

United States Patent [19]

Spriggs

[11] Patent Number: 5,662,505

[45] Date of Patent: Sep. 2, 1997

[54] ELECTRICALLY POWERED CANOE WITH FISHING ACCESSORIES

[76] Inventor: Charles Spriggs, Gingerwood Ct., Wilmington, Del. 19808

[21] Appl. No.: 751,746

[22] Filed: Nov. 18, 1996

[51] Int. Cl.[6] ..... B60L 11/02; B63B 00/00

[52] U.S. Cl. ..... 440/6; 114/343; 114/347

[58] Field of Search ..... 114/343, 363, 114/347, 364; 440/6; D12/317, 302, 300

[56] References Cited

U.S. PATENT DOCUMENTS

| | | | |
|---|---|---|---|
| 3,628,204 | 12/1971 | Hoffman, Jr. | 114/343 |
| 4,662,303 | 5/1987 | Duff | 114/343 |
| 5,265,555 | 11/1993 | Hodge, Jr. | 114/343 |

*Primary Examiner*—Edwin L. Swinehart

[57] ABSTRACT

An electrically powered canoe with fishing accessories comprises a canoe having an essentially hollow interior, the canoe including a bow, a stern, a central region, a port side and a starboard side; and the central section including a center console with a bow portion, a stern portion and a central portion, the center console including a plurality of accessories, the accessories including a seat and a cooler positioned on the bow portion of the center console, the accessories further including a primary battery, a secondary battery, a compass, a fish finder and a rod rack positioned on the central portion of the center console, a fan and a fishing rod being positioned upon the rod rack, the primary battery including a plurality of buttons and switches operatively coupled to the accessories of the bow, stern and central section, the stern portion of the center console including an electrical control panel operatively coupled to the primary and secondary batteries.

10 Claims, 7 Drawing Sheets

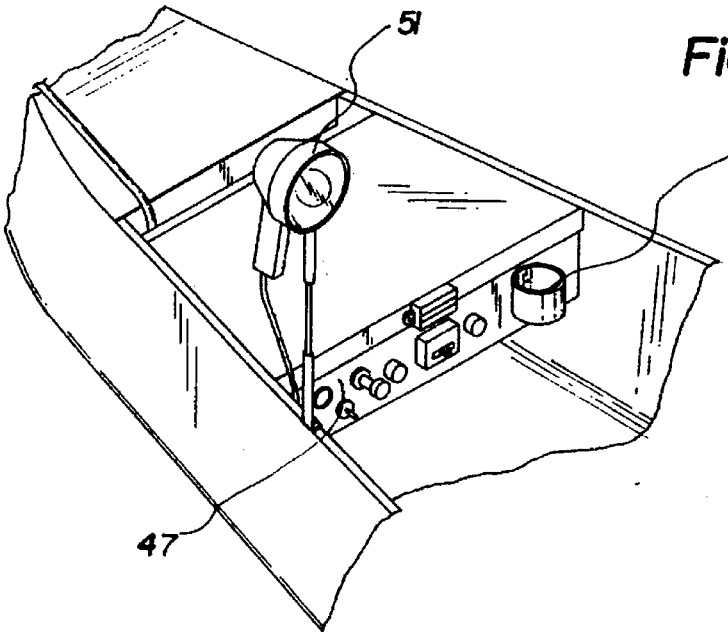
Fig. 10
Fig. 11
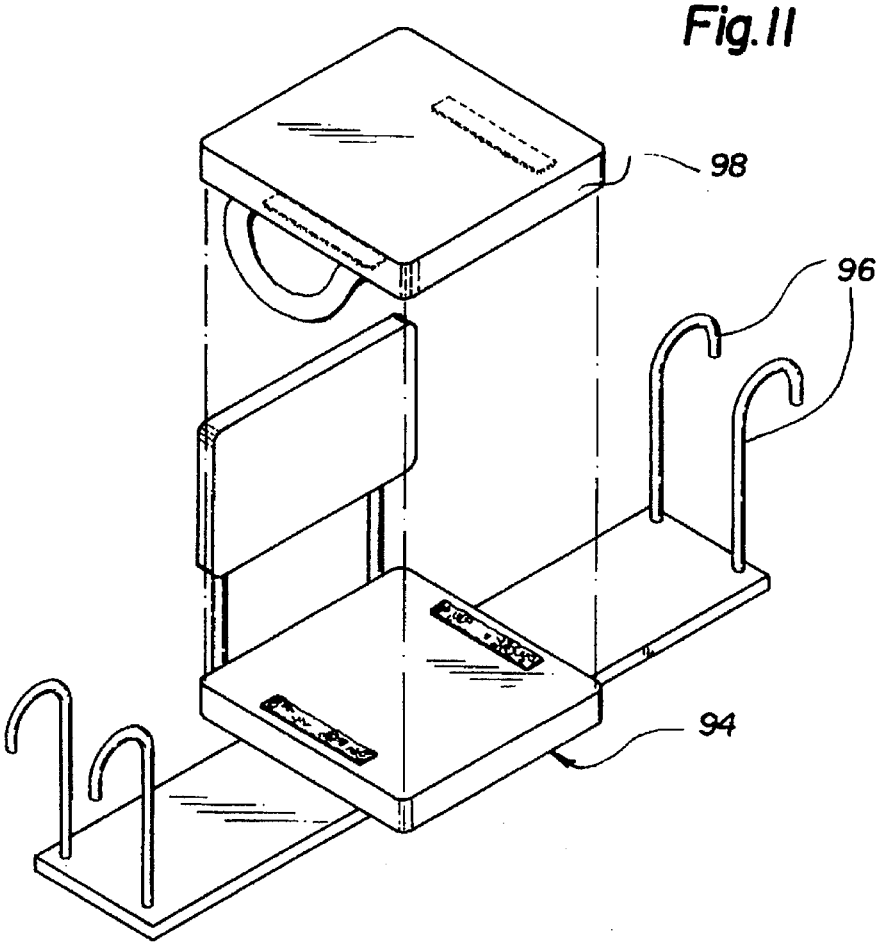

ELECTRICALLY POWERED CANOE WITH FISHING ACCESSORIES

BACKGROUND OF THE INVENTION

1. Field of the Invention

The present invention relates to an electrically powered canoe with fishing accessories and more particularly pertains to utilizing the various accessories of the canoe to facilitate fishing activities.

2. Description of the Prior Art

The use of canoes is known in the prior art. More specifically, canoes heretofore devised and utilized for the purpose of engaging in water activities are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,265,555 to Hodge, Jr. a bass boat kit apparatus.

U.S. Pat. No. 4,226,206 to Wilson discloses a retractable propulsive means for small boats.

U.S. Pat. No. Des. 349,270 to Ito et al. discloses a canoe.

U.S. Pat. No. 4,398,488 to Mathieu discloses a removable canoe-carried cooler.

U.S. Pat. No. 4,641,594 to Birkett discloses a canoe conversion kit.

Lastly, U.S. Pat. No. 3,958,289 to Carson discloses a canoe storage compartment.

In this respect, the electrically powered canoe with fishing accessories according to the present invention substantially departs from the conventional concepts and designs of the prior art, and in doing so provides an apparatus primarily developed for the purpose of utilizing the various accessories of the canoe to facilitate fishing activities.

Therefore, it can be appreciated that there exists a continuing need for a new and improved electrically powered canoe with fishing accessories which can be used for utilizing the various accessories of the canoe to facilitate fishing activities. In this regard, the present invention substantially fulfills this need.

SUMMARY OF THE INVENTION

In view of the foregoing disadvantages inherent in the known types of canoes now present in the prior art, the present invention provides an improved electrically powered canoe with fishing accessories. As such, the general purpose of the present invention, which will be described subsequently in greater detail, is to provide a new and improved electrically powered canoe with fishing accessories and method which has all the advantages of the prior art and none of the disadvantages.

To attain this, the present invention essentially comprises a new and improved electrically powered canoe with fishing accessories comprising, in combination: a canoe having an essentially hollow interior, the canoe including a bow, a stern, a central region, a port side and a starboard side, the port and starboard sides of the canoe each including a fishing rod holder, an outrigger and an oar, the port side including a port side motor with a detachable fishing rod holder, a forward/reverse switch, a speed switch, and a detachable steering handle; the bow having an enclosed region and an upwardly extending point, the bow having a plurality of accessories affixed thereto, the accessories including a bow motor and two anchors affixed thereto, the bow having bow electrical control panel formed therein, the control panel including a cigarette lighter, a fan, a plurality of fuses, a light and a gooseneck lamp, a plurality of switches being operatively coupled to the accessories; the stern having an enclosed region and an upwardly extending point, a plurality of accessories including a vertically positioned removable light and a bass boat swivel seat being positioned on the stern; the central section including a center console with a bow portion, a stern portion and a central portion, the center console including a plurality of accessories, the accessories including a bass boat swivel seat and a primary cooler positioned on the bow portion of the center console, the accessories further including a primary battery, a secondary battery, a secondary cooler, a fish finder and a rod rack positioned on the central portion of the center console, the fish finder and the secondary cooler being positioned upon the primary battery, a fan and a fishing rod being positioned upon the rod rack, a compass being affixed to the secondary cooler, the primary battery including a plurality of buttons and switches operatively coupled to the accessories of the bow, stern and central section; the stern portion of the center console including a horizontal panel, a tackle box, a motor foot control, a bilge pump and a stern electrical control panel, the horizontal panel including two anchor rollers, two anchor winches and at least two anchor lines, the anchor lines each being coupled to an anchor, the tackle box being positioned below the horizonal panel and including a plurality of drawers, the stern control panel being positioned adjacent the tackle box and including a lamp, a plurality of fuses, a cigarette lighter and a plurality of switches being operatively coupled to the accessories of the stern portion of the center section, the motor foot control being operatively coupled to the bow and starboard side motors, the bow and stern electrical control panels being operatively coupled to the primary and secondary batteries; a canoe rack bed having two free ends, in an inoperative orientation the canoe being positioned upon the canoe rack bed in an inverted orientation, the rack bed being formed in a generally rectangular configuration including tapered ends to allow the canoe to slide thereacross, the rack bed including a plurality of notches, the notches allowing the canoe to rest securely within the rack bed, a plurality of car mounts, each car mount formed with a first looped end being coupled to the canoe rack bed and a second looped end adapted to be coupled to an automobile; a plurality of canoe tie-downs each having two free ends, each tie-down being fabricated of nylon rope enclosed in an elastomeric hose, the hose preventing weathering and abrasion of the rope, each free end of each tie-down including a chain and a hook attached thereto, the hook being coupled to the rack bed; and a plurality of canoe rack extenders each being fabricated of ½" pipe, each rack extender being slidably positioned into a free end of the canoe rack bed, the rack extenders supporting the canoe while loading and unloading, the rack extenders being positioned within the rack bed support when not in use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electrically powered canoe with fishing accessories which has all of the advantages of the prior art canoes and none of the disadvantages.

It is another object of the present invention to provide a new and improved electrically powered canoe with fishing accessories which may be easily and efficiently manufactured and marketed.

It is further object of the present invention to provide a new and improved electrically powered canoe with fishing accessories which is of durable and reliable constructions.

An even further object of the present invention is to provide a new and improved electrically powered canoe with fishing accessories which is susceptible of a low cost of manufacture with regard to both materials and labor, and which accordingly is then susceptible of low prices of sale to the consuming public, thereby making such electrically powered canoe with fishing accessories economically available to the buying public.

Still yet another object of the present invention is to provide a new and improved electrically powered canoe with fishing accessories which provides in the apparatuses and methods of the prior art some of the advantages thereof, while simultaneously overcoming some of the disadvantages normally associated therewith.

Still another object of the present invention is utilizing the various accessories of the canoe to facilitate fishing activities.

Lastly, it is an object of the present invention to provide a new and improved electrically powered canoe with fishing accessories comprises a canoe having an essentially hollow interior, the canoe including a bow, a stern, a central region, a port side and a starboard side; and the central section including a center console with a bow portion, a stern portion and a central portion, the center console including a plurality of accessories, the accessories including a seat and a cooler positioned on the bow portion of the center console, the accessories further including a primary battery, a secondary battery, a compass, a fish finder and a rod rack positioned on the central portion of the center console, a fan and a fishing rod being positioned upon the rod rack, the primary battery including a plurality of buttons and switches operatively coupled to the accessories of the bow, stern and central section, the stern portion of the center console including an electrical control panel operatively coupled to the primary and secondary batteries.

These together With other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 discloses an alternative embodiment of the bow electrical control panel.

FIG. 11 is a perspective view of a removable floatation seat.

The same reference numerals refer to the same parts through the various Figures.

DESCRIPTION OF THE PREFERRED EMBODIMENT

Figure 1:
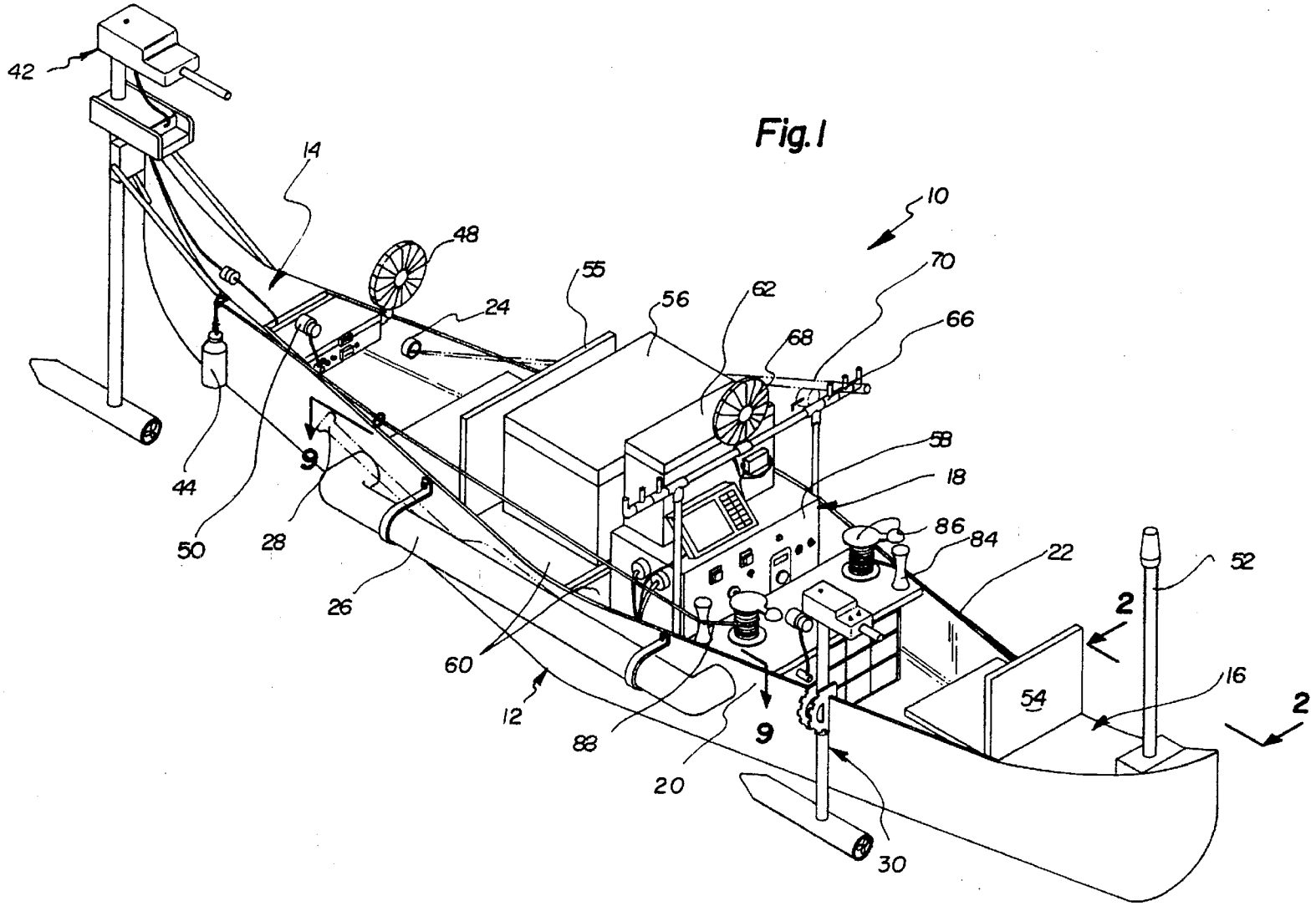
FIG. 1 is a perspective view of the preferred embodiment of the electrically powered canoe with fishing accessories constructed in accordance with the principles of the present invention.

With reference now to the drawings, and in particular to FIG. 1 thereof, the preferred embodiment of the new and improved electrically powered canoe with fishing accessories embodying the principles and concepts of the present invention and generally designated by the reference numeral 10 will be described.

The present invention, the electrically powered canoe with fishing accessories 10 is comprised of a plurality of components. Such components in their broadest context include a canoe 12, a bow 14, a stern 16 and a center console 18. Such components are individually configured and correlated with respect to each other so as to attain the desired objective.

Figure 3:
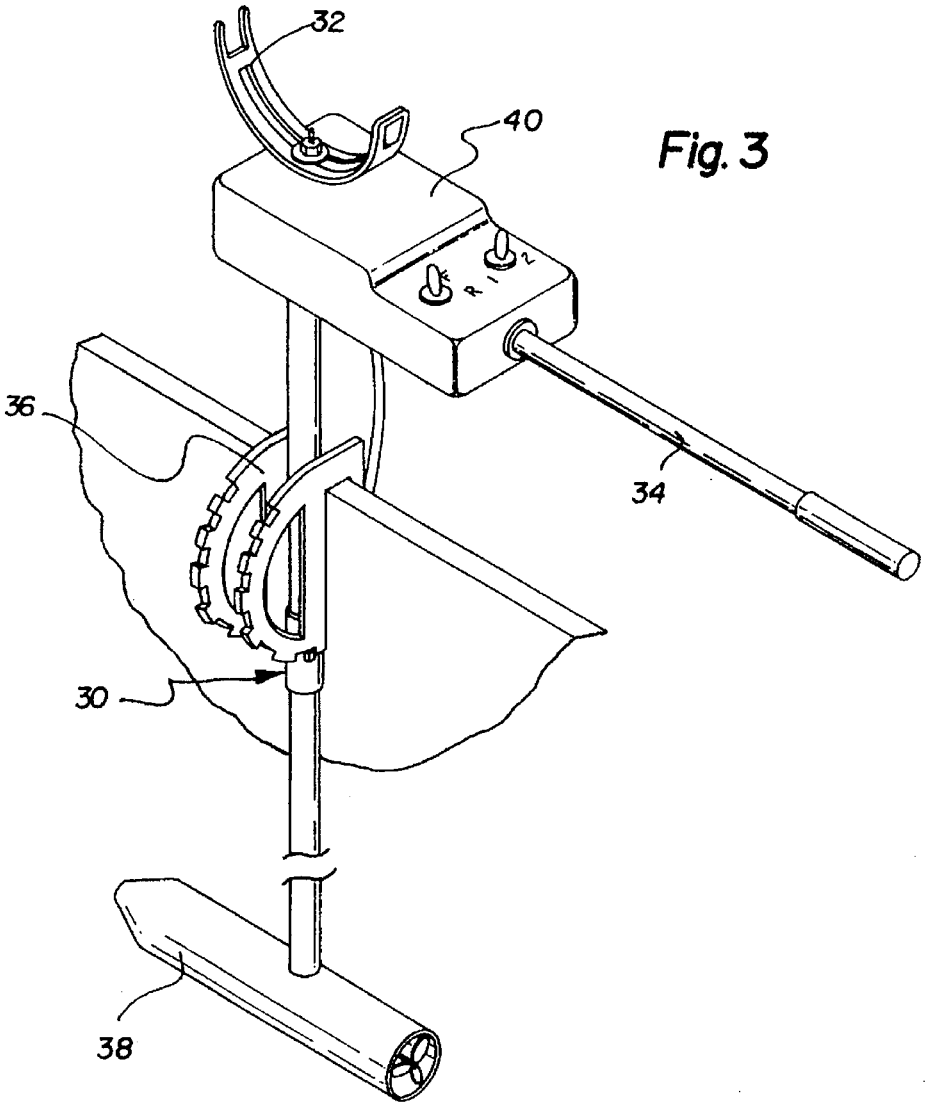
FIG. 3 is an isolated perspective view of the port side motor.
Figure 5:
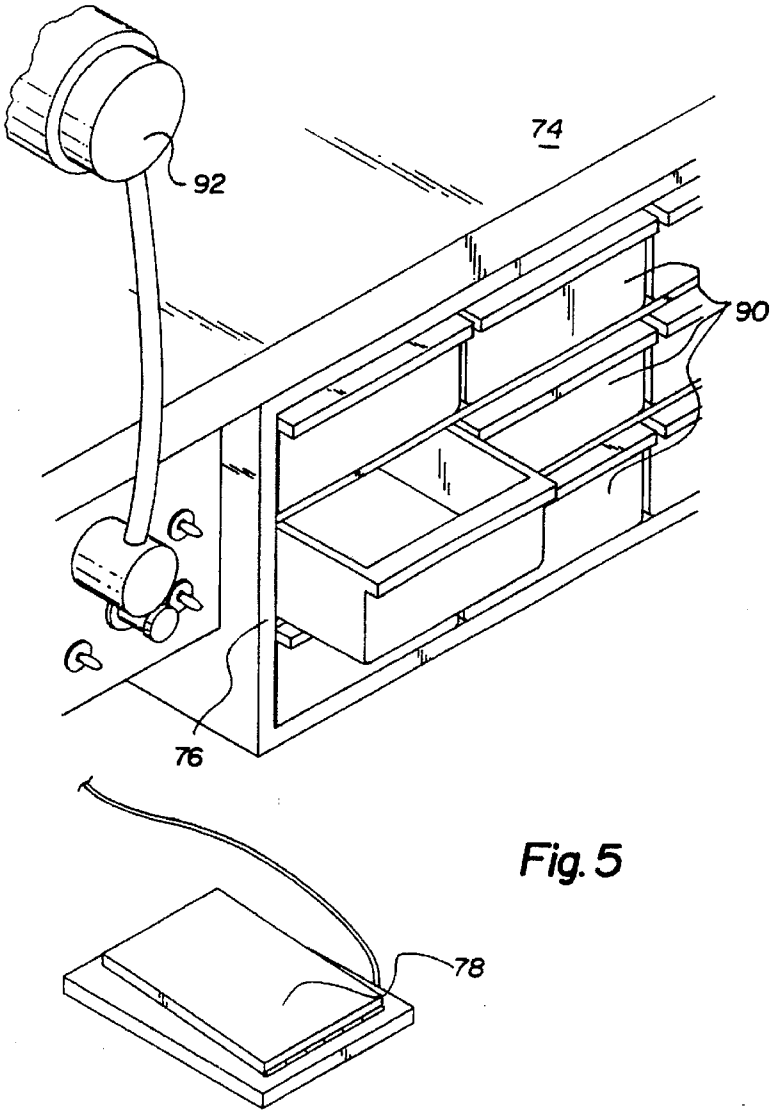
FIG. 5 is an isolated perspective view of the tackle box.

More specifically, the canoe 12 is fabricated of aluminum and has an essentially hollow interior. The canoe includes a bow 14, a stern 16, a central region, a port side 20 and a starboard side 22. The port and starboard sides of the canoe each include a fishing rod holder 24, an outrigger 26 and an oar 28. The port side of the canoe includes a port side motor 30. The motor has a detachable fishing rod holder 32, a forward/reverse switch, a speed switch and a detachable steering handle 34. The port Side motor is attached to the port side of the canoe by a motor holder 36. The motor consists of a propeller portion 38 and the head of motor 40. Note FIGS. 1 and 3.

Figure 2:
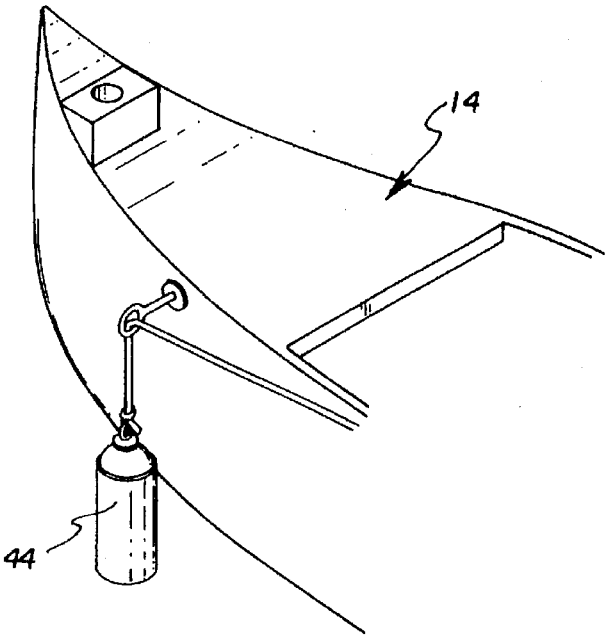
FIG. 2 is an isolated perspective view of the stern of the canoe.
Figure 7:
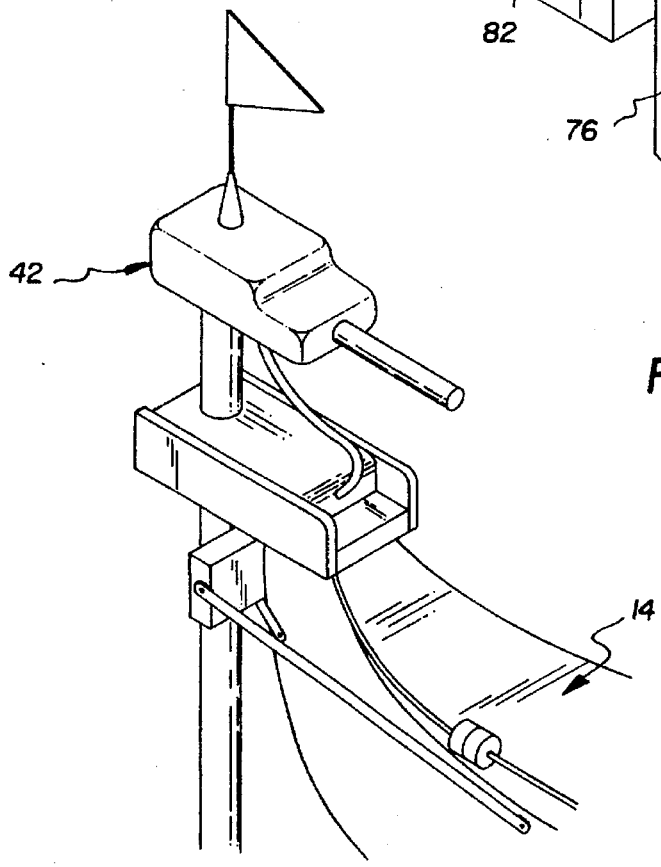
FIG. 7 is a perspective view of the bow motor.
Figure 8:
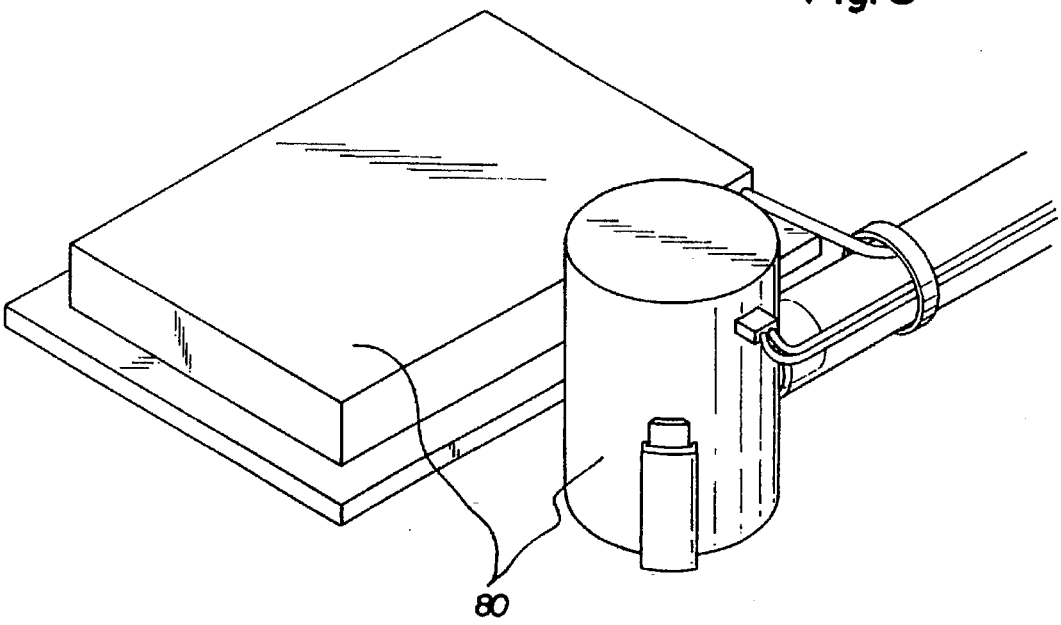
FIG. 8 is a perspective view of the bilge pump.
Figure 9:
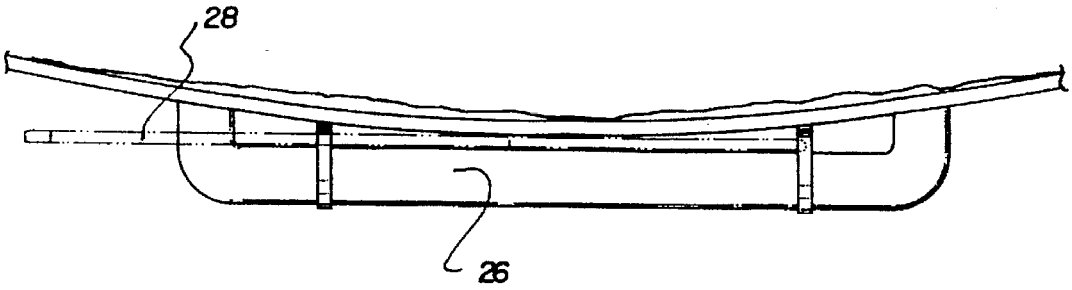
FIG. 9 is a perspective view of the outrigger and oar.

The bow 14 has an enclosed region and an upwardly extending point. The bow has a plurality of accessories affixed thereto. The accessories include a bow motor 42 and two anchors 44 affixed to it. The bow has bow electrical control panel 46 formed in it. The control panel includes a cigarette lighter, a fan 48, a plurality of fuses, a light and a goose neck lamp 50. A plurality of switches are operatively coupled to the accessories. Note FIGS. 1,2 and 7. In an alternative embodiment of the apparatus a lamp 51 and cupholder 53 are included on the control panel 47. Note FIG. 10.

The stern 16 has an enclosed region and an upwardly extending point. A plurality of accessories which include a vertically positioned removable light 52 and a bass boat swivel seat 54 are positioned on the stern. Note FIG. 1.

Figure 4:
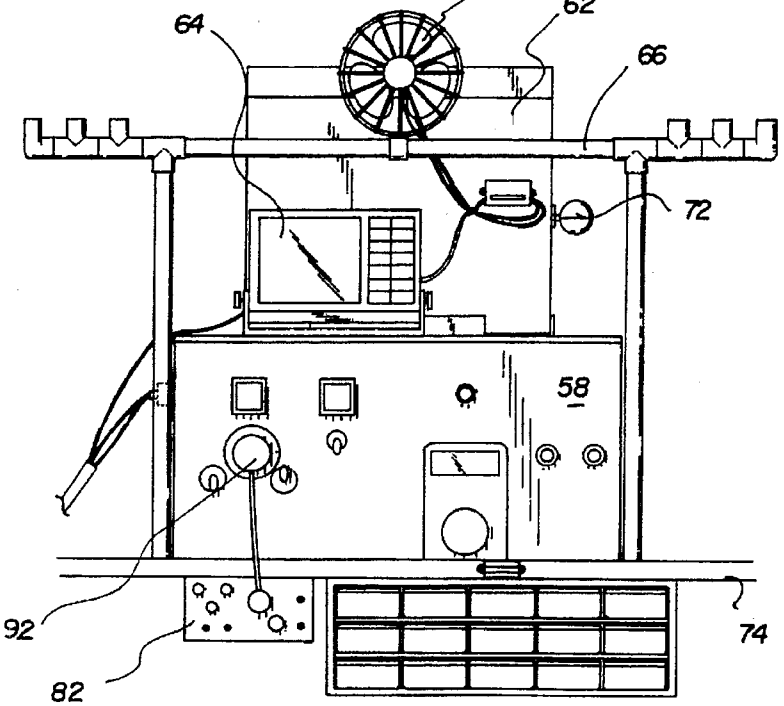
FIG. 4 is an isolated perspective view of the center console.
Figure 6:
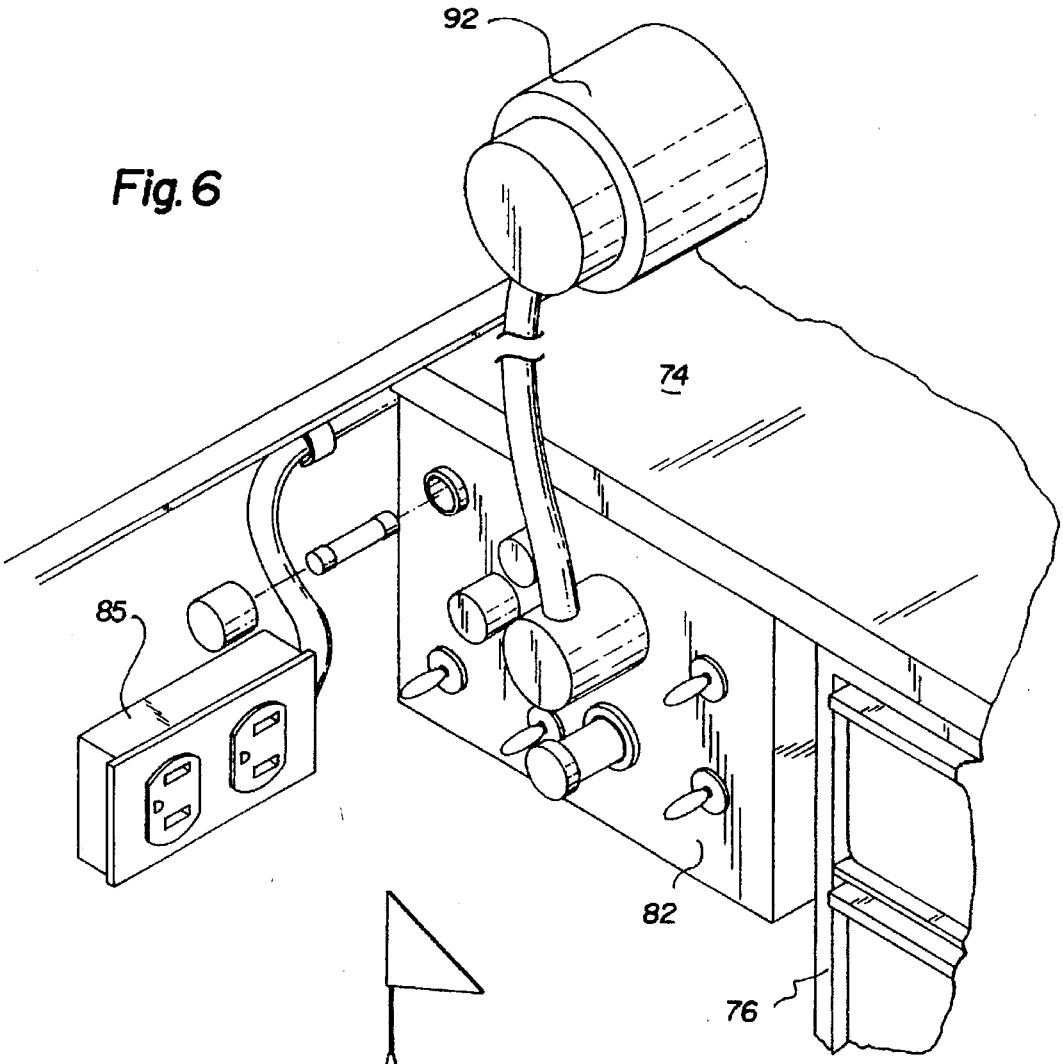
FIG. 6 is perspective view of the fuse and electrical box.

The central section includes a center console 18 with a bow portion, a stern portion and a central portion. The center console includes a plurality of accessories. The accessories include a bass boat swivel seat 55 and a primary cooler 56 positioned on the bow portion of the center console. The accessories further include a primary battery 58, a secondary battery 60 and a secondary cooler 62, a fish finder 64 and a rod rack 66 are positioned on the central portion of the center console. The fish finder and the secondary cooler are positioned upon the primary battery. Note FIGS. 1 and 4.

A fan 68 and a fishing rod 70 are positioned upon the rod rack. A compass 72 is affixed to the secondary cooler. The primary battery includes a plurality of buttons and switches operatively coupled to the accessories of the bow, stern and central section. Note FIGS. 1 and 4.

The stern portion of the center console includes a horizontal panel 74, a tackle box 76, a motor foot control 78, a bilge pump 80 and a stern electrical control panel 82. The horizontal panel 74 includes two anchor rollers 84, two anchor winches 86 and at least two anchor lines 88. The anchor lines each are coupled to an anchor 44. The tackle box is positioned below the horizonal panel and includes a plurality of drawers 90. Note FIGS. 1, 4, 5 and 6.

The stern control panel is positioned adjacent the tackle box and includes a lamp 92, electrical outlet 85, a plurality of fuses and a cigarette lighter. The panel also includes a plurality of switches which are operatively coupled to the accessories of the stern portion of the center section. The motor foot control 78 being operatively coupled to the bow and starboard side motors, the bow and stern electrical control panels being operatively coupled to the primary and secondary batteries. Note FIGS. 4 and 6.

A removable passenger 94 seat is positionable at various locations on the canoe. The passenger seat includes hooks 96 and a floatation device 98. The floatation device is attached to passenger seat by hook and loop fasteners.

Figure 12:
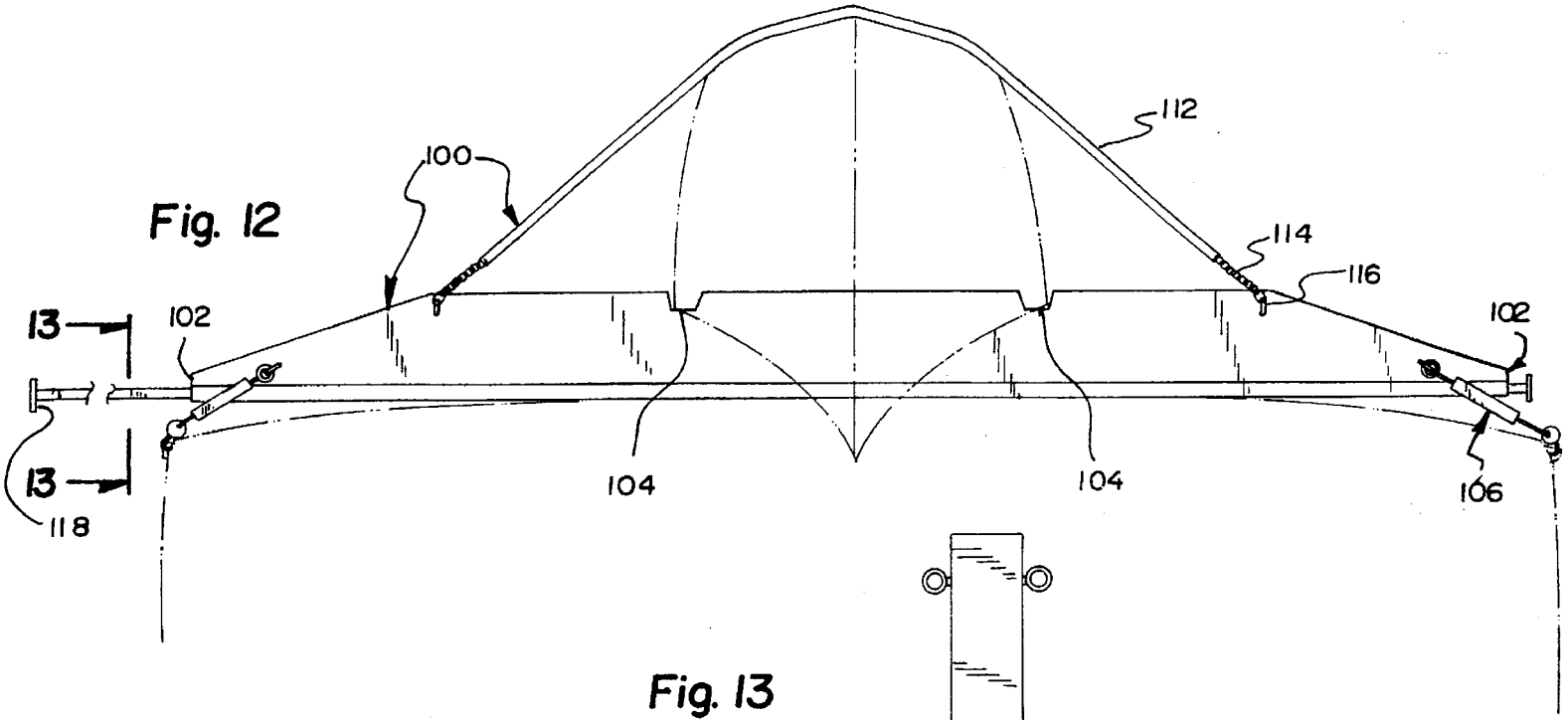
FIG. 12 is a perspective view of the canoe rack bed and the canoe tie down.
Figure 13:
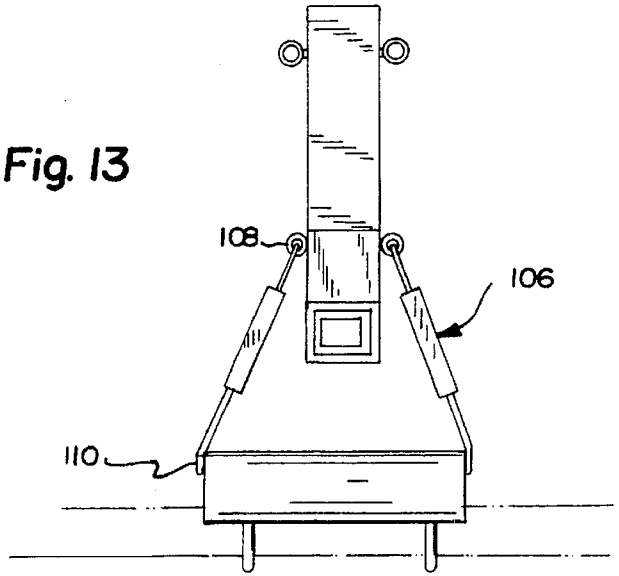
FIG. 13 is a side perspective view of the canoe rack bed and the canoe tie downs taken along section line 13—13 of FIG. 12.

A canoe rack bed 100 is included in the apparatus. In an inoperative orientation the canoe is positioned upon the canoe rack bed in an inverted orientation. The rack bed is formed in a generally rectangular configuration including tapered ends 102. The ends allow the canoe to easily slide across the rack bed. The rack bed includes a plurality of notches 104. The notches allow the canoe to rest securely within the rack bed. A plurality of car mounts 106 are included with the apparatus. Each car mount is formed with a first looped end 108 which is coupled to the canoe rack bed and a second looped end 110 which is adapted to be coupled to an automobile. Note FIGS. 12 and 13.

A plurality of canoe tie-downs 112 each have two free ends. Each tie-down is fabricated of nylon rope which is enclosed in an elastomeric hose. The hose prevents the weathering and abrasion of the rope. Each free end of each tie-down includes a chain 114 and a hook 116. The hook 116 is coupled to the rack bed 100. Note FIGS. 12 and 13.

A plurality of canoe rack extenders 118 are each fabricated of ½" pipe. Each rack extender is slidably positioned into a tapered end 102 of the canoe rack bed 100. The rack extenders support the canoe while loading and unloading. The rack extenders are positioned within the rack bed support 100 when not in use. Note FIGS. 12 and 13.

Additional information regarding the preferred embodiment of the electrically powered canoe with fishing accessories is set forth below.

TWO BASS-BOAT SWIVEL SEATS—rear seat is detachable so canoe can be carried upside down on van—front seat is moved rearward of original canoe seat to give more leg and storage room and move weight toward the stern.

BOW TRANSOM

Materials used: aluminum & steel piping, 2×6 lumber, ⅛" pegboard, pipe strapping.

Allows motor to be mounted in center of bow.

Allows motor to pull the boat giving more stable steering than when mounted on the stern.

Gives convenient hand-hold for handling canoe.

By lifting the stern of canoe when loading and unloading, the bow transom allows canoe to be handled upside down without the tendency of the canoe to rotate or flip.

One 28-pound Minkota ELECTRIC BOW MOTOR with remote foot control mounted in the cockpit.

A MOTOR DIRECTION INDICATOR has been added to the top of the motor so the driver can determine the motor direction without having to look "around" the front passenger. Materials used in direction indicator: ⅝" dowel, ⅛" wire rod, spring door stop. The door stop prevents excessive stress on the motor housing when the stern is run into weeds. trees, bushes—the indicator just bends out of the way.

One 8-pound Minkota ELECTRIC STEERING MOTOR mounted on the port side of the cockpit for steering while cruising—I've added a RUDDER to the shaft for quicker steering response.

This motor's steering handle has been removed and replaced with a detachable and longer steering handle. This prevents the handle from interfering with fishing.

Originally this motor only had forward speeds—it has been modified by adding two switches which now give it two speeds in both forward and reverse direction.

There is also a mount atop this motor for a fishing rod-holder. PRIMARY BATTERY BOX containing two 12-volt batteries in parallel—the battery box has these features:

Voltmeter with lighted dial mounted on side of box for checking charge.

Ammeter with lighted dial for monitoring power consumption rate.

Circuit breakers which also serve as power-supply switches.

Warning light to indicate when lighted dials are on.

One main power outlet and two auxiliary power outlets.

One outlet for connecting a third optional 12-volt battery in parallel.

Electrical buss architecture inside box to allow the easy removal an installation of batteries—only 4 connections.

Battery test switch for each battery—for checking charge.

Electrical connectors for plugging a digital voltmeter for accurate measurement of charge.

Electrical architecture allows charging battery without lifting lid of battery box—just plug the battery charger into the outlet on the box.

The two switches/circuit breakers allow you to select either one or both batteries as the power source.

The primary battery box can be carried in either a fore or aft position—aft with two passengers, fore with one passenger—prevents the canoe from being stern heavy with one passenger.

SECONDARY BATTERY BOX which plugs into the primary box giving a total of 3 batteries—the third battery is optional—allows for extended operation of the canoe without charging—with three batteries the range is probably on the order of 40 miles or three days of average fishing—it has some of the same features of the primary battery box.

Both BATTERY BOXES have a detachable two-person easy-carry system for loading/unloading the power supply—consists of a 1 inch pipe which is slipped over two bolts and fastened with wing nuts for carrying—avoids handling batteries—avoids lifting injuries.

CHARGING SYSTEM (kept in van):

A modified 10-amp timed charger which can be plugged into the battery box to charge without removing the lid from the battery box—avoids handling batteries for charging—allows charging inside closed box making injury very unlikely if a battery explodes.

Batteries will also charge off van charging system by plugging battery boxes into van outlet. The van outlet is switchable so the batteries will charge off the alternator (allows charging batteries while traveling to and from fishing spot) or off an alternate battery under the hood of the van (this allows charging overnight without running the van engine).

Hummingbird FISH/DEPTH FINDER mounted atop the battery box—transducer is swing-mounted on the port side of the cockpit so it can be stowed along-side the canoe when not in use or when transporting the canoe. The swing mount for the transducer is made from shaped ¼" steel rod.

TACKLE BOX rack-mounted under aft table—tackle box slides into rack at launch time—allows for convenient access to tackle without taking up leg room. A tool box is used to store and carry the under-table tackle box to and from van.

SPOOL of 40-pound monofilament line mounted on the rod holder—used for making fishing leaders.

Fold-down ROD RACK for storing rods/reels while not in use—keeps them out of the way—if the canoe is run through trees/bushes the rod holders will fold down to avoid getting the rack hung on the bush or pulling a rod out of the canoe. The tips of the rods go into PVC pipe attached to the inside of the canoe forward of the front passenger.

SLOTS in rear table for storing pliers and other tools used during fishing—also a recessed area for storing bait spray (fish attractant).

HINGED COOLER for bait and fish atop the battery box mounted in a frame to prevent its sliding.

COMPASS mounted on the side of the cooler.

TABLES fore and aft.

Cigar LIGHTERS fore and aft.

Built-in ASHTRAYS fore and aft.

CUP HOLDERS fore and aft & beside front passenger seat.

Two 10-pound lead ANCHORS on 40-foot lines mounted port bow and starboard stern. Anchors are made by pouring lead into a used spray-paint can with an eye bolt inserted through the top.

ANCHOR ROLLERS on rear table and on gunwales for routing anchor rope and changing rope's direction—vertical rollers mounted on tables have copper bushing to prevent the swelling of wooden roller from binding and stopping the rolling action.

Two ANCHOR WINCHES operated from the cockpit—both anchors can be dropped simultaneously by the turning a knob giving extremely accurate positioning.

A 3-GPM automatic electric BILGE PUMP operated from the cockpit—canoe can be left in rain overnight and be dry in the morning with negligible power drain on the batteries.

Port and starboard OUTRIGGERS mounted amidships—outriggers provide a 25-pound buoyant force at a six inch lever arm—makes canoe stable enough to fish standing up—made of 4-inch PVC pipe.

PADDED GUNWALES for forward-passenger leg rest—made from pipe insulation.

Customized ACCESSORY BOX for carrying first aid kit, axe, rope, tools, spot light, insect repellent, etc.

BOX LID CLOSERS mounted such that they can be easily accessed from the top and so the top will pull straight up—good for tight places—box doesn't have to be moved to access contents—good for places where there is not enough room for a hinged lid to open.

PADDLE STORAGE between outriggers and canoe—allows for easy access to paddles by both passengers - uses no space inside canoe.

Front and rear 2-speed FANS for passenger comfort—front fan is mounted on the gunwale—rear fan is mounted on the cooler.

RUNNING LIGHTS mounted port, starboard and stern.

Goose-neck SPOT LIGHT which mounts on gunwale on port side of front passenger area—plugs into power outlet in front passenger area. Goose neck is made from piece of garden hose, coat hanger and ¼" copper pipe. For night fishing.

COMPARTMENT LIGHTS in front and rear passenger areas—for night fishing.

Goose-neck TABLE LIGHTS on both front and rear tables—plug into power outlets on panels.

FUSE & SWITCH PANELS in both front and rear compartments. All electrical accessories are fused with easy access to fuses. Switches control fans, lights and bilge pump.

RULER for measuring fish affixed to rear table—sealed and weather-proofed.

Canoe RACK BED

Bed is tapered so canoe can be easily slid from the edge of the bed to the center for securing.

Bed is notched so canoe will rest securely without danger of a cross wind shifting it.

A safety chain is connected between the rack and the canoe—prevents an updraft from lifting the canoe off the bed—also secures canoe if a tie-down becomes loose.

CANOE TIE-DOWNS

Nylon rope inside garden hose—hose prevents weathering and abrasion of rope.

Spring, chain and hook attached to end of rope to avoid requirement to tie and untie rope when load/unloading canoe.

Handle inserted in chain for easily pulling spring so hook can be attached to rack to secure canoe.

Canoe RACK EXTENDERS

½" pipe which is inserted into end of rack to support canoe while loading and unloading—this allows one person to load/unload by handling one end at a time. The extenders also greatly simplify and reduce the effort required for two people to load/unload the canoe.

Rack could be designed so extenders slide into rack bed support when not in use.

Canoe rack GUTTER MOUNT—hooks prevent rack from rising on opposite end when canoe is resting on extenders.

THIRD PASSENGER SEAT (removable)

Seat has hooks to fit over gunwales—surface of seat is below the level of the gunwales to keep passenger's center of gravity low.

Surface of seat has velcro strips so throwable flotation device can be placed on seat without slipping. (Throwable also has velcro strips)

LIVE WELL for bait or for fish landed

Water is circulated via 3 GPM bilge pump—water flows from bottom of cooler out a horizontal pipe at the top. The top pipe has five holes for water to circulate back into the cooler.

A piece of flexible shower hose is used to connect to the bilge pump to fill and empty the cooler—makes dipping and pouring unnecessary.

NIGHT FISHING SIDE LIGHTS

Two lights operated by switches are attached to either side of the canoe. One switch on the bow panel controls lights on one side—switch on the rear panel controls the lights on the other side. Lights shine toward bank to make the shoreline visible but not brightly lit.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved electrically powered canoe with fishing accessories comprising, in combination:

a canoe having an essentially hollow interior, the canoe including a bow, a stern, a central region, a port side and a starboard side, the port and starboard sides-of the canoe each including a fishing rod holder, an outrigger and an oar, the port side including a port side motor with a detachable fishing rod holder, a forward/reverse switch, a speed switch, and a detachable steering handle;

the bow having an enclosed region and an upwardly extending point, the bow having a plurality of accessories affixed thereto, the accessories including a bow motor and two anchors affixed thereto, the bow having bow electrical control panel formed therein, the control panel including a cigarette lighter, a fan, a plurality of fuses, a light and a gooseneck lamp, a plurality of switches being operatively coupled to the accessories;

the stern having an enclosed region and an upwardly extending point, a plurality of accessories including a vertically positioned removable light and a bass boat swivel seat being positioned on the stern;

the central region including a center console with a bow portion, a stern portion and a central portion, the center console including a plurality of accessories, the accessories including a bass boat swivel seat and a primary cooler positioned on the bow portion of the center console, the accessories further including a primary battery, a secondary battery, a secondary cooler, a fish finder and a rod rack positioned on the central portion of the center console, the fish finder and the secondary cooler being positioned upon the primary battery, a fan and a fishing rod being positioned upon the rod rack, a compass being affixed to the secondary cooler, the primary battery including a plurality of buttons and switches operatively coupled to the accessories of the bow, stern and central region;

the stern portion of the center console including a horizontal panel, a tackle box, a motor foot control, a bilge pump and a stern electrical control panel, the horizontal panel including two anchor rollers two anchor winches and at least two anchor lines, the anchor lines each being coupled to an anchor, the tackle box being positioned below the horizonal panel and including a plurality of drawers, the stern control panel being positioned adjacent the tackle box and including a lamp, a plurality of fuses, a cigarette lighter and a plurality of switches being operatively coupled to the accessories of the stern portion of the center section, the motor foot control being operatively coupled to the bow and port side motors, the bow and stern electrical control panels being operatively coupled to the primary and secondary batteries;

a canoe rack bed having two free ends, in an inoperative orientation the canoe being positioned upon the canoe rack bed in an inverted orientation, the rack bed being formed in a generally rectangular configuration including tapered ends to allow the canoe to slide thereacross, the rack bed including a plurality of notches, the notches allowing the canoe to rest securely within the rack bed, a plurality of car mounts, each car mount formed with a first looped end being coupled to the canoe rack bed and a second looped end adapted to be coupled to an automobile;

a plurality of canoe tie-downs each having two free ends, each tie-down being fabricated of nylon rope enclosed in an elastomeric hose, the hose preventing weathering and abrasion of the rope, each free end of each tie-down including a chain and a hook attached thereto, the hook being coupled to the rack bed; and a plurality of canoe rack extenders each being fabricated of ½" pipe, each rack extender being slidably positioned into a free end of the canoe rack bed, the rack extenders supporting the canoe while loading and unloading, the rack extenders being positioned within the rack bed support when not in use.

2. An electrically powered canoe with fishing accessories comprising:

a canoe having an essentially hollow interior, the canoe including a bow, astern, a central region, a port side and a starboard side; and the central region including a center console with a bow portion, a stern portion and a central portion, the center console including a plurality of accessories, the accessories including a seat and a cooler positioned on the bow portion of the center console, the accessories further including a primary battery, a secondary battery, a compass, a fish finder and a rod rack positioned on the central portion of the center console, a fan and a fishing rod being positioned upon the rod rack, the primary battery including a plurality of buttons and switches operatively coupled to the accessories of the bow, stern and central section, the stern portion of the center console including an electrical control panel operatively coupled to the primary and secondary batteries.

3. The electrically powered canoe with fishing accessories as set forth in claim 2 and, further including:

a horizontal panel, a tackle box, a motor foot control and a bilge pump being coupled to the stern portion of the center console, the tackle box being positioned below the horizonal panel and including a plurality of drawers, the stern control panel being positioned adjacent the tackle box and including a lamp, a plurality of fuses, a cigarette lighter and a plurality of switches being operatively coupled to the accessories of the stern portion of the center section, the motor foot control being operatively coupled to bow and port side motors, the bow and stern electrical control panels being operatively coupled to the primary and secondary batteries.

4. The electrically powered canoe with fishing accessories as set forth in claim 3 wherein the port side motor including a detachable fishing rod holder, a forward/reverse switch, a speed switch, and a detachable steering handle.

5. The electrically powered canoe with fishing accessories as set forth in claim 4 and further including:

a fishing rod holder, an outrigger and an oar being coupled to the port and starboard sides of the canoe.

6. The electrically powered canoe with fishing accessories as set forth in claim 5 wherein the bow has an enclosed region and an upwardly extending point, the apparatus further including:

a plurality of accessories being affixed to the bow, the accessories including said bow motor and two anchors affixed thereto, the bow having bow electrical control panel formed therein, the control panel including a cigarette lighter, a fan, a plurality of fuses, a light and a gooseneck lamp, a plurality of switches being operatively coupled to the accessories.

7. The electrically powered canoe with fishing accessories as set forth in claim 6 wherein the stern has an enclosed region and an upwardly extending point, the apparatus further including:

a plurality of accessories including a vertically positioned removable light and a bass boat swivel seat being positioned on the stern.

8. The electrically powered canoe with fishing accessories as set forth in claim 7 wherein the horizontal panel of the stern portion of the control panel includes two anchor rollers, two anchor winches and at least two anchor lines, the anchor lines each being coupled to an anchor.

9. The electrically powered canoe with fishing accessories as set forth in claim 8 and further including:

a removable passenger seat being positionable at various locations on the canoe, the passenger seat including hooks and a floatation device.

10. The electrically powered canoe with fishing accessories as set forth in claim 2 and further including:

a canoe rack bed having two free ends, in an inoperative orientation the canoe being positioned upon the canoe rack bed in an inverted orientation, the rack bed being formed in a generally rectangular configuration including tapered ends to allow the canoe to slide thereacross, the rack bed including a plurality of notches, the notches allowing the canoe to rest securely within the rack bed, a plurality of car mounts, each car mount formed with a first looped end being coupled to the canoe rack bed and a second looped end adapted to be coupled to an automobile;

a plurality of canoe tie-downs each having two free ends, each tie-down being fabricated of nylon rope enclosed in an elastomeric hose, the hose preventing weathering and abrasion of the rope, each free end of each tie-down including a chain and a hook attached thereto, the hook being coupled to the rack bed; and a plurality of canoe rack extenders each being fabricated of ½" pipe, each rack extender being slidably positioned into a free end of the canoe rack bed, the rack extenders supporting the canoe while loading and unloading, the rack extenders being positioned within the rack bed support when not in use.

* * * * *